United States Patent [19]

Zengerer

[11] 3,971,244

[45] July 27, 1976

[54] IMPACT TOOL

[76] Inventor: Hans Zengerer, Bundesstrasse 221, A-8410 Wildon, Austria

[22] Filed: Feb. 27, 1974

[21] Appl. No.: 446,536

[30] Foreign Application Priority Data

Mar. 5, 1973 Austria ..... 1923/73

[52] U.S. Cl. ..... 72/395; 72/705; 72/465; 72/481; 72/479

[51] Int. Cl.[2] ..... B21D 1/12; B21D 25/00; B21J 7/18; B21J 13/02

[58] Field of Search ..... 72/465, 466, 476, 477, 72/479, 481, 482, 483, 705, 395; 81/52.3

[56] References Cited

UNITED STATES PATENTS

| | | | |
|---|---|---|---|
| 385,540 | 7/1888 | Bierhart | 72/481 |
| 2,010,996 | 8/1935 | Junkers | 72/395 |
| 2,407,573 | 9/1946 | Nelson | 72/395 |
| 2,428,173 | 9/1947 | Moore | 72/395 |
| 2,428,675 | 10/1947 | Moore | 72/395 |
| 2,623,426 | 12/1952 | Daniels | 72/477 X |
| 2,627,771 | 2/1953 | Phillips et al. | 72/477 X |
| 2,906,150 | 9/1959 | Stewart | 72/465 |
| 3,332,271 | 7/1967 | Salt | 72/395 |
| 3,340,721 | 9/1967 | Salt | 72/395 |

FOREIGN PATENTS OR APPLICATIONS

| | | | |
|---|---|---|---|
| 160,816 | 6/1922 | United Kingdom | 72/395 |

*Primary Examiner*—Milton S. Mehr
*Assistant Examiner*—Donald M. Gurley
*Attorney, Agent, or Firm*—Salter & Michaelson

[57] ABSTRACT

An impact tool for dressing metal sheets, particularly for repairing damaged vehicle bodies, has a tool carrier, in a bore of which there are guided at least two jaws separated from each other in the rest position of the tool by resilient elements, e.g. springs or rubber elements. The jaws are guided for a limited stroke between a rigid abutment formed by the front face of the tool carrier and a stop formed by a bolt fixed to the tool carrier and intersecting holes of the stems of the jaws with play. The jaws are loaded by at least one resilient element, e.g. a helical spring, abutted with its one end against the end of the bore of the tool carrier and with its other end against the inner end of each jaw. Surfaces having portions diverging in direction to the outer ends of the jaws force the jaws radially inwardly when the jaws hit the metal sheet to be treated.

9 Claims, 10 Drawing Figures

IMPACT TOOL

The present invention refers to an impact tool for dressing metal sheet, particularly for repairing damaged vehicle sheet metal bodies, comprising a tool carrier and a tool head having a stem and slidingly guided with the stem within the tool carrier and being resiliently loaded in direction to a stop limiting its stroke in longitudinal direction of the tool carrier.

Dressing of deformed sheet metal material, particularly of vehicle body work, is quite difficult with impact tools as used up until now even when heating the area to be dressed. By compressing the material at the impact area, the material flows in a direction toward the area adjacent to the impact area. This results in large inner stresses being created and, in many cases, results in bosses or bulges in the metal sheet. If the metal sheet of the vehicle body work shows cracks, the prior known impact tools will frequently enlarge these cracks and result in a deformation of the edges of the metal sheet adjacent to said cracks. A further drawback of the usual dressing methods is that with continued deformation of the metal sheet, heating of the area to be treated occurs. By heating the metal sheet, any protective coating that had been applied to the metal sheet such as anti-rust compositions, floor protective compositions or the like will be completely destroyed.

It is an object of the present invention to provide an impact tool of the type described which avoids the disadvantages of prior known tool constructions and particularly will permit cold working of the deformed vehicle body without bossing or bulging the metal sheet at the treated area. This object is, according to the invention, achieved by subdividing the tool head that is serrated at its front surface, transversely relative to its front surface into at least two movable jaws that are singly guided within the tool carrier on guide surfaces which diverge in a direction toward the tool head between a rigid abutment at the one hand and a stop limiting the stroke of the jaws in longitudinal direction of the tool carrier on the other hand the jaws also being maintained laterally spaced from one another by resilient members.

It is a particular advantage of such a construction that upon contact of the tool head with the surface to be treated, the movement of the tool head in impact direction is superimposed by a transverse movement of the jaws. Said transverse movement is only released immediately after the tool head has bounced the surface of the sheet part to be dressed, i.e. is released at the moment at which the teeth of the serrated front face of the jaws have entered the surface of the metal sheet. In view of the resistance against the teeth entering the sheet surface increasing with deeper penetration into the metal sheet, the jaws are shifted off the stop or end-chock provided on the tool carrier and in a direction toward the rigid abutment, whereby the jaws are moved in a transverse direction and in direction toward one another because of the inclined guide surfaces of the tool carrier. Due to the anchoring action of the serrated front faces of the jaws entering the metal sheet, the metal sheet is subjected to a cold deformation acting in the plane of the metal sheet and in direction toward the center of the impact area, so that the cold deformation of the metal sheet is counteracting the flow of material which has been effected at the impact area and resulted in making the sheet material more thinwalled. By suitably adjusting the parameters decisive for this phenomenon, especially the angle of inclination of the guide surfaces, the stroke of the jaws and the forces exerted by the elastic members, which may be formed of springs and/or rubber elements, undesired stresses within the material that normally build up are avoided. Also avoided is bossing or bulging of the sheet area treated. On the contrary, uniformly plane or, if desired, vaulted surfaces are formed and cracks possibly present in the sheet metal will be nearly closed so that the subsequent welding operation will be substantially simplified.

An impact tool according to the invention may be used for treating sheet metal of any type and works surprisingly well even when dressing a damaged vehicle body that is formed of aluminium which heretofore could be worked only with usual tools and with great difficulty and only by well-trained and expert personnel.

Examples of embodiments of an impact tool according to the invention are schematically shown in the accompanying drawings, in which.

Figure 9:
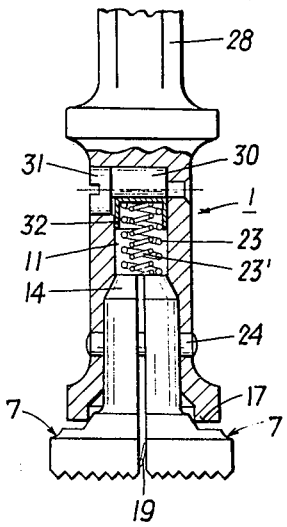
Figure 9:
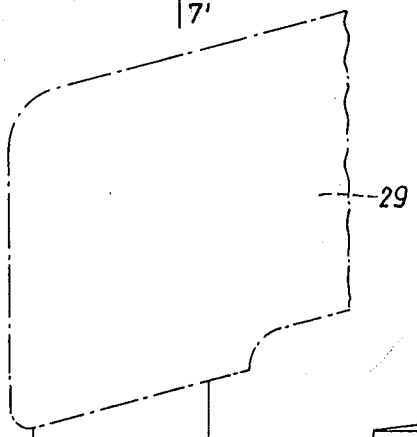
Figure 8:
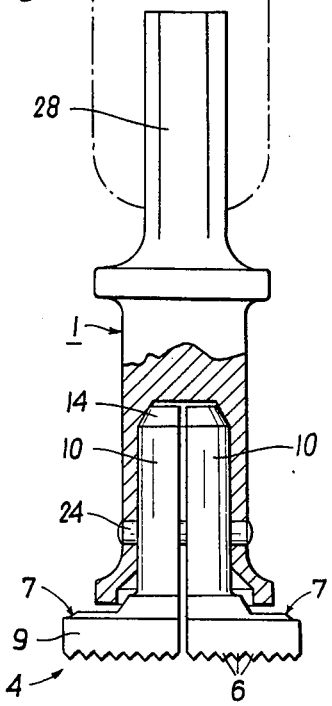
Figure 10:
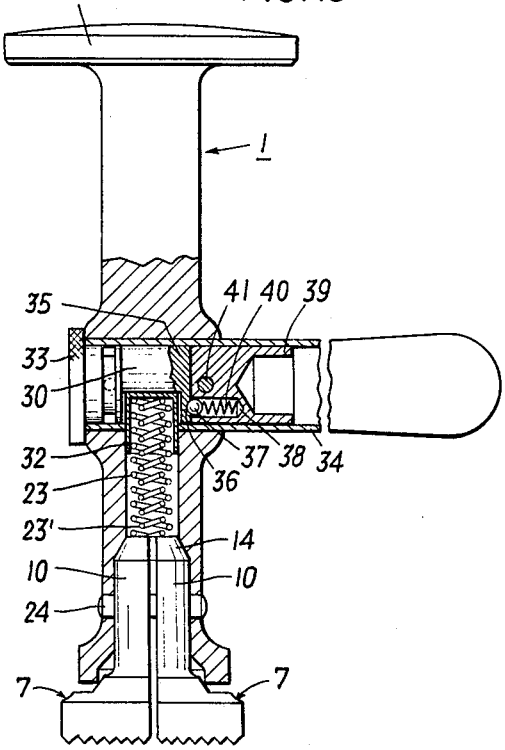

FIGS. 8, 9 and 10 each show a further embodiment, partially in longitudinal section, of an impact tool according to the invention.

Figure 1:
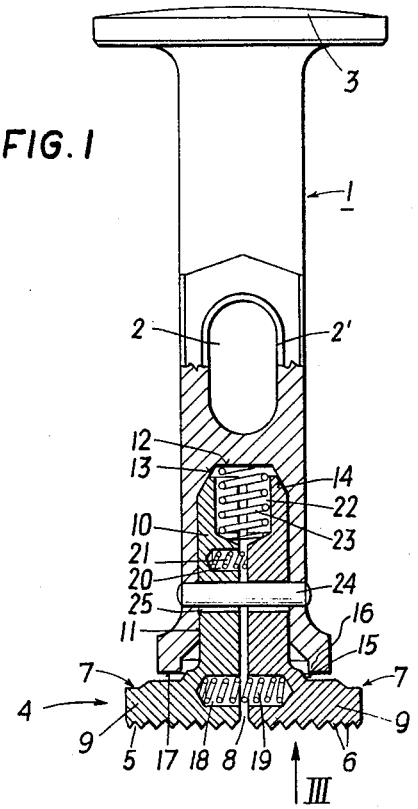
FIG. 1 is a longitudinal sectional view with parts shown in elevation of, the head of the impact tool as it appears prior to engaging a metal sheet.
Figure 2:
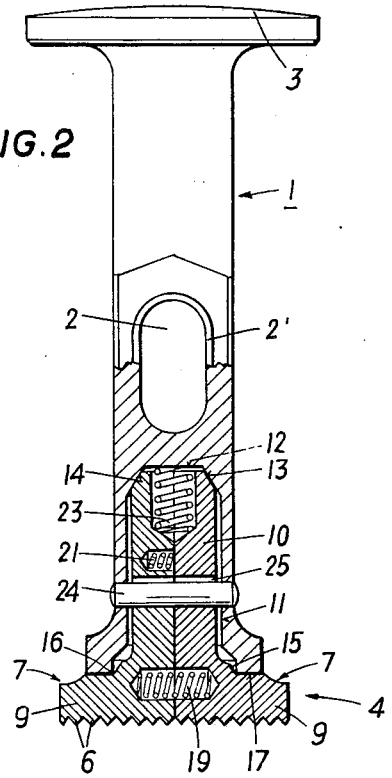
FIG. 2 is a view similar to FIG. 1 and showing the position of the tool after it has engaged the metal sheet.

Generally, the impact tool according to FIGS. 1 and 2 has the shape of a hammer and comprises a substantially cylindrical tool carrier 1 provided with an elongated slot 2' for housing the hammer handle 2. One end of this tool carrier 1 is formed as a vaulted or convex-shaped hammer end 3, whereas the tool head 4 provided at the other end of the tool carrier 1 is formed of two jaws 7 being provided on their front face or working face 5 with serrations or teeth 6 and being movably arranged relative to one another. According to this embodiment (FIGS. 1, 2 and 3) only two jaws 7 are provided between which, in rest position of the tool (FIG. 1), a central gap 8 is provided which extends in longitudinal direction of the tool carrier 1.

Each jaw 7 comprises a plate-like members 9 and a stem portion 10 extending vertically from the plate-like member 9. The stem portions 10 of the jaws 7 each may have half-circular or rectangular cross section and are inserted into and guided in a blind-end bore of the tool carrier 1, forming a take-up bore for the jaws. The take-up bore 11 is provided with a conical wall portion 13 converging in direction to the bottom wall 12 of bore 11 to form a frusto-conical configuration. Said conical wall portion 13 forms a guide surface for the conical cooperating surfaces 14 of the stem portions 10. This is particularly favourable in manufacturing, because the take-up bore 11 as well as the guide surfaces 13 can be manufactured on a lathe in one single operation step. At the area of the transition from the stem portion 10 to the plate-like member 9, the jaws 7 are provided with a further conical counter-surface 15 cooperating with the inner edge 16 of take-up bore 11 located at the front surface of the tool carrier 1. The annular front surface 17 of the tool carrier 1 forms a rigid abutment for the plate-like member 9 of the jaws 7. Thus, the forces exerted by the inertia of the operated tool carrier 1 are evenly distributed when impacting the movable jaws 7.

The jaws 7 are provided with aligned blind bores 18 which open in direction to the gap 8. An interchangeable and prestressed resilient element, preferably a helical spring 19, is inserted into these bores 18 and resiliently acts on the jaws 7 in transverse direction relative to the direction of impact and presses the jaws in radial direction against the cylindrical portion of take-up bore 11. A further blind bore 20 is provided within the stem 10 n10 of one of said both jaws 7 and houses a further resilient element, preferably a prestressed helical spring 21.

Each stem portion 10 is provided at its inner end with a recess so that both recesses form an axial blind-end bore 22 which contains a prestressed resilient element, preferably a helical spring 23 which rests on the bottom wall 12 of the tape-up bore 11. The helical spring 23 presses the jaws 7 against an end-chock or stop member being formed by a bolt 24 which is inserted into a transverse bore within the tool carrier 1 and penetrates with sufficient play elongated slots 25 in the stem portions 10 of both jaws 7, so that this bolt 24 limits axial movement of the jaws 7.

The operation of the impact tool shown in FIGS. 1 and 2 is as follows:

In rest position of the tool (FIG. 1) the jaws 7 are pressed away from each other under the action of the springs 19, 21 in the end-position as is defined by bolt 24 under the action of spring 23. In this end-position the jaws 7 are radially spaced from each other and axially spaced from the front face 17 of the tool carrier 1. When the tool executes a stroke against the metal sheet portion (not shown), the teeth 6 will enter into the surface of the metal sheet part more or less deeply and will become anchored therein with rapidly increasing resistence to deformation of the metal sheet. The axially acting force of the helical spring 23 will be overcome by the still remaining impact energy of the tool carrier 1, so that the jaws 7 are further shifted into the take-up bore 11 until the plate-like member 9 of the jaws engages the annular front face 17 of the tool carrier 1 (FIG. 2). In view of the jaws 7 being guided along the conical wall portion 13 and by the inner edge 16 of the take-up bore 11, the jaws 7 are simultaneously displaced in radial direction and in direction to one another until they will contact one another with their inner boundary surfaces and the gap 8 will become closed. In view of this transverse movement of said both jaws 7 the metal sheet will, on account of the jaws 7 being anchored within the metal sheet by the teeth 6, be subjected to transverse deformation acting in the plane of the metal sheet and being superimposed by the dressing effect of the tool head 4 so that the flow of material caused by the impact energy in direction to the periphery of the impact area is compensated. In this manner, internal stresses within the metal sheet are reduced or removed and subsequent bossing or bulging of the dressed area of the metal sheet part is avoided.

Figure 3:
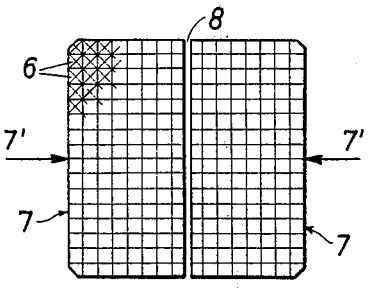
FIG. 3 is a bottom plan view of the tool head illustrated in FIG. 1 and taken in the direction of the arrow.
Figure 4:
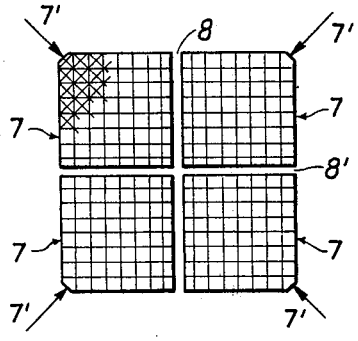
FIGS. 4 and 5 are bottom plan views of modified forms of tool heads.
Figure 5:
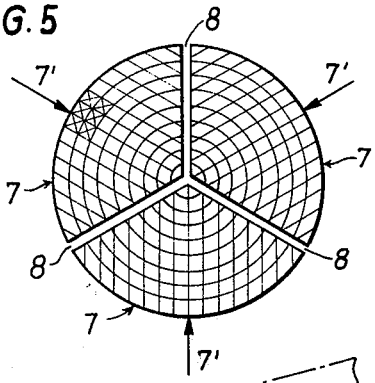

As is shown in the embodiments according to FIGS. 3 to 5, the number and shape of the tool jaws 7 may be varied. In the most simple case (FIG. 3), two rectangular jaws 7 are provided having regularly arranged teeth 6, said jaws 7 completing a square outer contour. The direction of movement of these jaws 7 during the end-phase of the impact process is illustrated by arrows 7'.

The tool head shown in FIG. 4, however, consists of four jaws 7, in the rest position being separated from each other by two intersecting gaps 8, 8', said jaws 7 being moved in accordance with arrows 7' in diagonal direction relative to one another against the action of spring elements or the like, as it has been described with reference to FIGS. 1 and 2 and the helical springs 19, 21.

The tool head shown in FIG. 5 has a circular outer or peripheral shape and is formed of three jaws 7 having a cross section of the form of a sector of a circle, said jaws 7 in the rest position being separated from one another by gaps 8 displaced against each other for an angle of 120°. Also within this embodiment the relative movement of the jaws 7, when engaging the metal sheet is in direction to the centre of the tool head (direction of arrow 7'), against the action of said springs.

The arrangement and the shape of the serrations or teeth 6 may be varied. The teeth 6 may for instance have unsymetrical flanks, the steeper flanks on adjacent jaws facing one another. By suitably selecting the angle of inclination of the teeth flanks as well as by suitably selecting the number of the teeth and the distribution of the teeth over the front of the jaws the most favourable action onto the metal sheet can be achieved.

Figure 6:
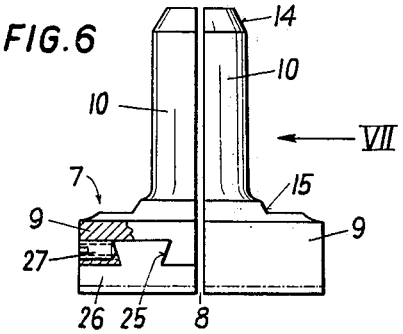
FIG. 6 is an elevational view with parts shown in section, of a modified embodiment of the invention.
Figure 7:
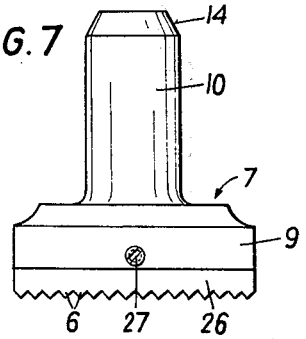
FIG. 7 is a side elevational view of the embodiment according to FIG. 6 taken in the direction of arrow VII of FIG. 6.

FIGS. 6 and 7 represent an embodiment of jaws 7 provided with interchangeable teeth. For this purpose, the plate-like member 9 of each jaw 7 is provided with a dove-tail groove 25 into which a teeth carrier plate 26, provided with the teeth 6, may be shifted with a ledge having a counter-profile corresponding to the cross-section of the groove 25. The carrier-plate 26 is fixed in its position by a worm screw 27 which can be screwed into the groove 25.

In an impact tool as shown in FIG. 8, the tool carrier 1 has an axially extending protrusion 28 by means of which the tool may be clamped in an impact device 29, i.e. a pneumatic hammer, indicated in the drawing by dot-dashed lines. By means of a set of such tools having tool heads of various design, e.g. tool heads with concave or convex operating surface, a wide variety of dressing work can be done with one single prime mover even on severely deformed and thick-walled metal sheets and thereby eliminating substantial physical stress and providing the possibility of rapidly interchanging the tool.

FIG. 9 shows an embodiment in which the force of the axial helical spring 23 loading the jaws 7 can be adjusted to a desired value. For this purpose, an eccentric member 30 is rotatably arranged at the inner end of the take-up bore 11 within the tool carrier 1 and is connected with a socket head cap screw 31, which can, for instance, be turned by means of a screw driver. The inner end of the helical screw 23 is surrounded by a spring basket 32 engaging the eccentric member 30.

In the embodiment shown in FIG. 10 the eccentric member 30 is adjusted by means of an adjusting disc 33 provided with a knurled surface, said adjusting disc 33 being connected to the eccentric member 30 and being rotatably supported on the front end of the tubular handle 34 of the hammer-like tool. The eccentric member carries a disc 35 at that side of the spring basket 32 opposed to the adjusting disc 33. The disc 35 is provided with a plurality of rests cooperating with a ball 37, which is supported within a bore 38 provided within a stiffening member 39 inserted into the handle 34. The ball 37 is pressed against the disc 35 by means of a spring 40. A securing pin 41 or the like is provided for connecting the stiffening member 39 with the handle 34.

For changing the characteristic of the spring acting in axial direction on the jaws 7 a further helical spring 23' (FIG. 9, 10) of somewhat shorter length than that of spring 23 may be arranged within said spring 23, so that this helical spring 23' comes into action somewhat later than the spring 23 when the tool hits the metal sheet. For preventing said both springs 23, 23' from mutually disturbing their operation, one of these springs is a right-hand spring and the other of these springs is a left-hand spring.

Numerous further embodiments are possible and within the scope of this invention. The take-up bore 11 may, for instance, have the shape of a wholly conical bore, and the shaft portions 10 of the jaws 7 are equally provided with wholly conical counter-surfaces. Instead of such conical surfaces also wedge-surfaces in the bore 11 and/or the shaft portions 10 may be provided. Such a simple embodiment is, for instance, suitable for impact tools being provided with only two movable jaws 7.

Movable jaws 7 may also be provided at both ends of the hammer head in the same manner as herein before described. This provides the advantage of low prime costs of a tool-set.

Further, also wedges or threads can be used for displacing the inner abutment of said springs, thus serving for an adjusting means for adjusting the force exerted by the springs 23, 23'.

I claim:

1. A portable impact tool for dressing metal sheets, comprising a tool carrier having a take-up bore formed therein provided with guide surfaces and a closed inner end, a tool head positioned exteriorly of said carrier, a stem joined to said tool head and mounted in said carrier, said stem being slidably guided along said guide surfaces of said take-up bore and being spaced from said inner end when the tool is in a rest position, wherein a gap is formed between the stem and the inner end of said bore, aligned transverse openings formed in said carrier, transverse openings formed in said stem in alignment with the openings in said carrier and having a diameter that is greater than that of said openings, a transversely extending stop member fixed in the openings in said carrier and being loosely received in the openings in said stem and being engageable by said stem wherein the stem is limited in the movement thereof, a spring located in said take-up bore and abutting against said closed end thereof and against said stem so that said spring bridges said gap for resiliently loading said tool head in a longitudinal direction with respect to said tool carrier, said tool head having an outer face provided with serrations and that is divided transversely into at least two tool head portions, said tool head portions being movable relative to each other and being slidably guided within the tool carrier along said guide surfaces, each of said tool head portions including a jaw that is engageable with said metal sheets, a rigid abutment for said jaws defined by a surface formed on said tool carrier adjacent to said jaws, said jaws being movable in longitudinal direction of said take-up bore, whereby said abutment and said stop member defines the limit of longitudinal movement of said jaws, the inner and outer ends of said take-up bore being formed with inclined surface portions that diverge in a direction toward said jaws, said tool head having first and second inclined surfaces portions that are axially and longitudinally spaced from one another in said take-up bore and that cooperate with said bore to move said jaws into engagement with each other when said jaws strike the metal sheets to be treated, and resilient means interposed between said jaws and abutting thereagainst for maintaining said jaws laterally spaced from one another, when said jaws are in a rest position.

2. A portable impact tool as claimed in claim 1, each jaw comprising a plate-like member on which said serrations are formed and that is connected to said stem, said stem extending in a direction that is transverse to said plate-like member, said inclined surfaces portions being formed on the inner end of said stem and cooperating with the guide surfaces of the tool carrier, said take-up bore being defined by a stepped blind-end bore including two conical surface portions that form said diverging guide surface portions.

3. A portable impact tool as claimed in claim 2, said take-up bore having a frusto conical configuration.

4. A portable impact tool as claimed in claim 1, the serrations as formed on said jaws being defined by saw-teeth having flanks of different angles of inclination, the steeper tooth flanks of adjacent jaws facing one another.

5. A portable impact tool as claimed in claim 1, said front face of said jaws that is provided with said teeth being vaulted.

6. A portable impact tool as claimed in claim 1, said rigid abutment for said jaws comprising an annular surface formed by the front face of said tool carrier and surrounding said take-up bore, said stem portions of said jaws having holes formed therein, said stop member that limits the stroke of said jaws comprising a bolt that traverses said take-up bore and loosely extends through said holes of the stem portions of the jaws.

7. A portable impact tool as claimed in claim 1, said spring comprising at least one helical spring, adjusting means mounted on said carrier for adjusting said spring to vary the force acting on said tool head in a direction toward said stop member, said adjusting means including an eccentric member rotatably arranged on said tool carrier and supporting the inner end of said spring, and actuating means for rotating said eccentric member.

8. A portable impact tool as claimed in claim 7, said actuating means including an adjusting disc connected to said eccentric member, said adjusting disc being rotatable to rotate said adjusting member, wherein said spring is loaded in accordance with rotation of said eccentric member.

9. A portable impact tool as claimed in claim 8, said tool carrier being subdivided into two portions that are arranged one behind the other with respect to the axis of said take-up bore and being interconnected to each other by said adjusting means.

* * * * *